United States Patent [19]

Knowles

[11] Patent Number: 4,514,126

[45] Date of Patent: Apr. 30, 1985

[54] CORRUGATED STAPLE

[76] Inventor: James Knowles, 1275 Club Dr., Bloomfield Hills, Mich. 48013

[21] Appl. No.: 332,165

[22] Filed: Dec. 18, 1981

Related U.S. Application Data

[63] Continuation-in-part of Ser. No. 113,370, Jan. 18, 1980, abandoned.

[51] Int. Cl.[3] ..... E04C 3/12; E04C 3/292

[52] U.S. Cl. ..... 411/477; 52/730; 206/338; 206/340; 206/499; 411/464

[58] Field of Search ..... 411/477, 462–464, 411/912; 206/838, 340, 493, 499, 338

[56] References Cited

U.S. PATENT DOCUMENTS

| | | | |
|---|---|---|---|
| 461,154 | 10/1891 | Welteroth | 411/464 |
| 1,182,201 | 5/1916 | Norton | 411/465 |
| 1,321,092 | 11/1919 | Danner | 206/338 |
| 1,328,911 | 1/1920 | Cary | 411/465 |
| 2,046,339 | 7/1936 | McChesney | 411/464 |
| 2,122,814 | 7/1938 | Hansen | 206/340 |
| 2,156,682 | 5/1939 | Dimoush | 411/465 |
| 2,377,169 | 5/1945 | Mohr | 411/465 |
| 2,918,705 | 12/1959 | Pearce | 206/338 X |
| 3,553,794 | 1/1971 | Kneidl et al. | 206/340 X |
| 3,618,446 | 11/1971 | Black | 206/340 X |
| 3,722,671 | 3/1973 | Wright et al. | 206/499 X |
| 3,762,541 | 10/1973 | Hinden et al. | 206/499 X |
| 4,221,153 | 9/1980 | Medina | 411/464 |

*Primary Examiner*—Alfred C. Perham

*Attorney, Agent, or Firm*—Cullen, Sloman, Cantor, Grauer, Scott and Rutherford

[57] ABSTRACT

An improved corrugated staple or fastener for joining together wood members such as wood chords to form a joist-like wood beam. The staple, which is made of sheet metal, has corrugations oriented at three different angles relative to a reference line such as the edge of the staple which is to be inserted into the wood members. The corrugations which are oriented at the first and second angles pull the wood chord members toward each other and when the joist-like beam is subjected to loading, the orientation of the first and second corrugations compresses the wood chords toward each other and increases friction between the chords. The third corrugation is oriented so that when the staple is inserted into the wood chords, the fibers of the wood are temporarily displaced and thereafter move back toward their original position to resist any tendency of the staple to pull out of the chords. The third corrugation also increases the resistance of the staple to horizontal shear forces or bending.

3 Claims, 10 Drawing Figures

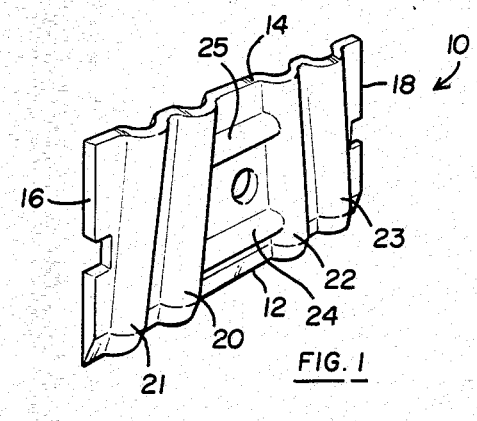
FIG. 1
FIG. 2
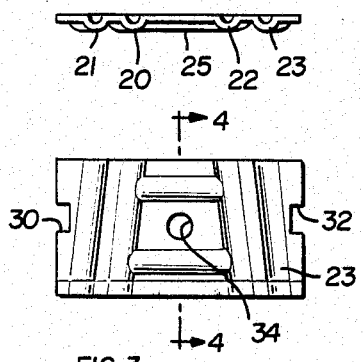
FIG. 3
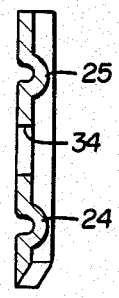
FIG. 4
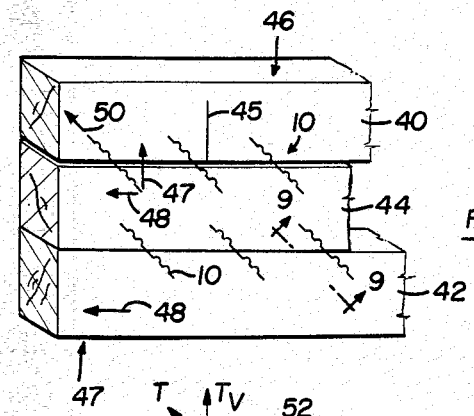
FIG. 5
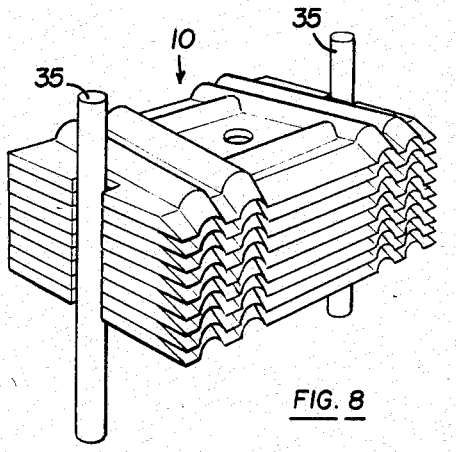
FIG. 8
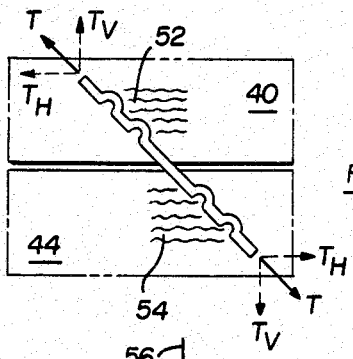
FIG. 6
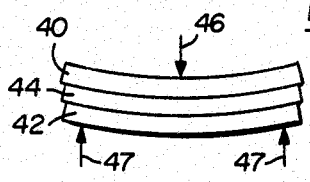
FIG. 7
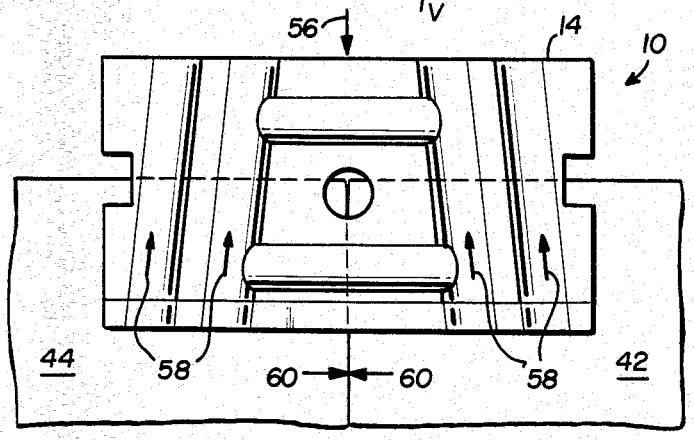
FIG. 9
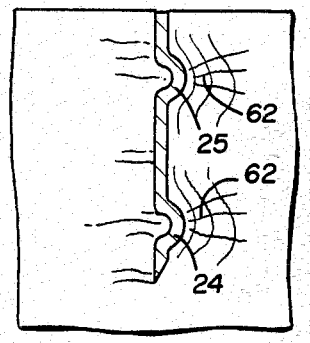
FIG. 10

CORRUGATED STAPLE

CROSS-REFERENCE TO RELATED APPLICATION

The present application is a continuation-in-part of my prior application "Composite Wood Beam and Method of Making Same" filed Jan. 18, 1980, Ser. No. 113,370now abandoned.

BACKGROUND OF INVENTION

The present invention relates to truss-like fabricated joists or beams made of wood chords and, more particularly, to an improved corrugated staple or metal fastener for joining together the wood chords to form a joist or beam.

In the construction of houses and other relatively small buildings, it is conventional to use solid wood beams for floor joists, ceiling supports, roof joists and the like. Generally such beams have nominal cross-sectional dimensions of 2×6, 4×8, 4×10, 4×12, etc., (inches). However, the increased demand and decreasing availability of high grade lumber has resulted in an increase in the price of lumber necessary for making such beams. The present invention relates to fabricating beams made of more readily available, less expensive, smaller cross-section lumber such as 2×4 which lumber may be interconnected with metal struts and where the wood members at the ends of the beam are interconnected with improved corrugated staples or fasteners.

Thus, in accomplishing the fabricated beam construction disclosed herein, it is contemplated to use additional wood strips interposed between the wood chords for absorbing shear load. The use of wood pieces between chords of a truss is known and illustrated, for example, in U.S. Pat. No. 3,748,809 issued July 31, 1973 and in Swiss Pat. No. 306,573 issued Apr. 30, 1955. However, the shear force absorption and resistance to bending is very limited in the constructions disclosed in those prior patents.

It is also known to utilize corrugated staples or fasteners to interconnect adjacent wood members in truss constructions as illustrated for example, in Australian Pat. No. 247,162 published Jan. 26, 1961.

Prior to the present invention, however, the corrugations of metal staples were oriented in a single direction or oriented in two directions at an acute angle relative to each other, and did not strive for fiber end loading as a result of horizontal shear. The prior staples, however, provided limited resistance to pulling out of the wood and limited resistance to bending when the beam was subjected to loading.

SUMMARY OF INVENTION

The invention herein contemplates an improved corrugated staple or fastener having corrugations oriented at three different angles. When the staples are inserted into adjacent wood members such as wood chords to form a joist-like beam, and thereafter when the beam is subjected to loading, the orientation of the corrugations resists shear forces, compresses the wood members toward each other and increases friction therebetween thus increasing the load bearing capabilities of the beam. Alternatively, rather than increasing the load bearing capability of the beam, fewer corrugated staples may be used than in the past while maintaining the same load bearing capability of a beam.

Yet another feature of the staples of the present invention is the orientation of the third corrugation which temporarily displaces wood fibers while the corrugated fastener is being inserted into the wood, with the wood fibers thereafter tending to return to their initial position to coact against the third corrugations to resist the corrugated fastener pulling out of the wood. Thus, the "third" corrugations provide the dual function of resisting shear bending and resisting any tendency of the staple to pull out of the wood.

The use of the corrugated staples of the present invention contemplates interconnecting the wood members together with the staples inserted at an angle in such a manner to tighten together the adjacent wood members under beam loading. That is, the corrugated staples are angled in the wood in such a manner that the staples are placed under tension when a load is placed on the beam. When the staples are placed under tension corrugations coact and interlock with the ends of the wood fibers. Such interlocking is to be contrasted to the use of a nail (or a non-corrugated fastener) which does not interlock with the fibers but is dependent on friction to resist pulling out of a beam when a load is placed on the beam. Thus, nails are not suitable for use in the type of construction described herein.

The fasteners of the present invention tighten or clamp the wooden members together in proportion to the load on the beam. The greater the load, the tighter fasteners tend to compress the adjacent wood parts together to thereby increasingly absorb shear loads and resist loosening, separation or relative movement of the wood members and to increase friction between the wood members without bending the fastener or exceeding the compressive strength of the wood.

DESCRIPTION OF THE DRAWINGS

The foregoing objects and advantages of the present invention, together with other objects and advantages which may be attained by its use, will become more apparent upon reading the following detailed description of the invention taken in conjunction with the drawings.

In the drawings, wherein like reference numerals identify corresponding components:

FIG. 1 is a perspective illustration of the improved corrugated staple of the present invention;

FIG. 2 is a plan view of the improved corrugated staple of the present invention;

FIG. 3 is a front elevation view of the improved corrugated staple of the present invention;

FIG. 4 is a cross-sectional view of the improved corrugated staple of the present invention as seen in the plane of arrows 4—4 of FIG. 3;

FIG. 5 is an illustration of one end of a joist-like beam where three wood chords are connected together through the use of the corrugated staples of the present invention;

FIG. 6 is an enlarged view of one fastener of the present invention interlocked with the fibers of the adjacent wood members of FIG. 5, with force vectors illustrated diagrammatically;

FIG. 7 is an illustration of how the chords of the beam of FIG. 5 will separate under loading in the absence of fasteners;

FIG. 8 is a perspective illustration of a plurality of corrugated staples according to the principles of the present invention illustrated in nesting fashion;

FIG. 9 is a diagrammatic illustration of the insertion of the corrugated staple or fastener of the present invention into adjacent wood chords as seen in the plane of arrows 9—9 of FIG. 5; and FIG. 10 is a diagrammatic cross-sectional illustration demonstrating the interaction of the wood fibers of the chord with the corrugations of the staple.

DETAILED DESCRIPTION OF THE INVENTION

FIG. 1 illustrates a staple 10 according to the principles of the present invention. The staple, which is made of metal, preferably sheet metal, is generally flat and of rectangular configuration having a leading edge 12 which may be sharpened or beveled to facilitate insertion of the staple into the wood and a trailing edge 14 on the opposite side of the staple from the leading edge 12. The staple also includes opposed sides 16, 18, each of which interconnects the leading and trailing edges of the staple. The staple is about one inch wide, between sides 16 and 18, and one-half inch high, between edges 12 and 14. Preferably, the staples are made of a high strength banding stock and have a thickness of about 0.020 inches.

The improved staple of the present invention includes corrugations having three different orientations relative to a reference plane such as the leading edge 12 of the staple. In the preferred embodiment of the present invention, there are three "series" of corrugations, each "series" having at least two corrugations. It should be understood, however, that the present invention may be practiced wherein each "series" of corrugations is defined as being only a single corrugation. It is also feasible, within the spirit and scope of the present invention, to have a different number of corrugations within each "series" of corrugations. In other words, it is not required that each "series" of corrugations have the same number of corrugations as any other "series" of corrugations. Thus, the number of corrugations in each of the three "series" may be varied.

The first series of corrugations includes first and second spaced-apart corrugations 20, 21 adjacent the first side 16 of the staple. Corrugations 20 and 21 have their longitudinal axes parallel to each other and at an angle of approximately 80° from the leading edge 12 measured in a counter-clockwise direction.

The second series of corrugations includes first and second corrugations 22, 23 which are adjacent the second side 18 of the fastener and are spaced apart from each other with their longitudinal axes parallel to each other and at an acute angle of about 80° from the horizontal leading edge 12 measured in a clockwise direction.

It may be appreciated that if the longitudinal axes of the corrugations are extended, then the longitudinal axis of each corrugation of the first series of corrugations will intersect the longitudinal axis of each corrugation in the second series of corrugations.

The present staple also includes a third series of corrugations including first and second parallel spaced apart corrugations 24, 25. In the preferred embodiment, these corrugations which comprise the third series of corrugations have their longitudinal axes parallel to each other and parallel to the leading edge 12 and the trailing edge 14 of the staple. Thus, the longitudinal axes of each of the corrugations in the third series of corrugations is at an angle of zero degrees relative to the leading edge 12. It is preferred that one of the corrugations 24 is adjacent the leading edge 12 and spaced inwardly therefrom and the other corrugation 25 in the third series of corrugations is spaced inwardly from the trailing edge 14 of the staple. If only a single corrugation is used as the third "series" of corrugations, then the corrugation would be halfway between the edges 12 and 14. It is also preferred that all of the corrugations are formed on the same surface of the staple.

It may also be appreciated that the longitudinal axis of each corrugation in the third series of corrugations intersects the longitudinal axis of each corrugation in each of the first and second series of corrugations.

The corrugations in the first and second series each extend the full height of the staple, from the leading edge to the trailing edge. The corrugations in the third series, however, do not extend the full width of the staple from the side 16 to the side 18 but rather extend only a sufficient distance to intersect the inwardmost corrugation 20 of the first series of corrugations and the inwardmost corrugation 22 of the second series of corrugations.

In the preferred form of the present invention, the sides 16 and 18 of each staple are provided with notches 30, 32, respectively and the staple is also provided with a central processing aperture 34 generally intermediate the two corrugations of the third series and the innermost corrugations 20, 22 of the first and second series of corrugations. When a plurality of staples 10 are nested together the notches and apertures of each staple are aligned above the notches and apertures of the staples therebeneath. Plastic guides 35 may be inserted in the notches to facilitate handling and shipment of the staples. In addition, the notches and apertures provide a guide when the staples are loaded into a gun or other machine which will thereafter be used to force the staples into wooden chords. If only a single corrugation is used as the third "series" of corrugations then no central aperture is provided.

FIG. 5 illustrates the use of the staples 10 of the present invention at one end of a joist or composite beam. The joist or composite beam includes upper and lower wood chords 40, 42 which are generally parallel and spaced apart from each other with a wood filler strip 44 therebetween. The staples 10 are inserted at an angle from the vertical 45 preferably in the range of 35° counter-clockwise from the vertical. If the staples are not oriented in the proper direction, e.g., if the staples at the end of the beam illustrated in FIG. 5 were inserted at an angle of 35° clockwise, the staples would go into compression under beam loading and thus would separate the wood chords from each other and fail to take the shear load.

With further reference to FIG. 5, when the beam is placed under load, the applied load acts in a downward direction on the top chord as illustrated generally by the arrow 46. The beam is typically supported by end supports thus providing an opposite upward end force illustrated at arrow 47. As the beam deflects between its opposite end supports there are horizontal shear forces between the upper chord 40 and the shear block or filler block 44 and similar forces between the shear block or filler block 44 and the lower chord 42. These forces are indicated by the arrows 48. The horizontal shear forces at the opposite end of the beam, now shown, are of course, in the opposite direction to the direction of arrows 48.

The resistance to bending of a beam is the cube function of the depth or height of the beam. Thus, a single wood strip such as chord 40 resists bending according to the cube of its height. The resistance to bending of the three relatively movable wood strips, e.g., chords 40, 42 and filler block 44, without fasteners, is the sum of the individual resistances. FIG. 7 illustrates the relative slippage of three chords 40, 42, 44 which are supported at their ends as at 47, and subjected to an applied load, as at 46, where the chords are not secured to each other by fasteners.

However, if the three laminate strips are fastened together so as to prevent slippage, i.e., to form a solid unit, the resistance to bending would be the cube of the overall height rather than the sum of the cubes of the individual heights of the wood members. Consequently, by locking the three wood members together to avoid relative slipping, there is a substantial increase in resistance to bending, since the solid unit provides 9 times the resistance than three members which are not fastened together.

In addition, the natural tendency of chords to move relative to each other under load, such as when a person is walking on the floor, normally tends to produce a squeaking sound which is common in floor constructions and by preventing the relative movement of the wood, there is no squeaking or noise.

By appropriately angling the staples 10, the three wood members 40, 44 and 42 may be interlocked together and relative motion therebetween completely eliminated. The precise angle of insertion of the leading edge 12 of the staples 10, relative to the vertical 45, may be determined from a consideration of the following factors.

First, it is desirable to place the staples in tension because the result of placing the staples in tension is to compress the wood members against each other. This increases static friction between adjacent wood members which friction provides additional resistance to slipping. However, the angle from the vertical cannot be too great because as the angle approaches 90° from the vertical, the staple would tend to be flat, i.e., almost horizontal, and will pull out of the wood, and reduce the static friction loading rather than holding the wooden members together.

A second consideration for the angle of the staple is that if the angle from the vertical is too small, the staple will not resist bending, i.e., the staple will bend over in the wood, or will pull the wood across the grain in the weakest direction. By way of example, where the compressive strength of Southern Pine is about 475 p.s.i. across the grain, the compressive strength is almost 3 times as strong, or about 1350 p.s.i. on end fiber loading. The ratio of almost 3 times as strong for end fiber loading is typical for most types of wood used in making joists or beams for use in houses.

Hence, there are opposite criteria for determining the desirable angle at which the fasteners are inserted relative to the vertical. The angle cannot be too small because the staples will tend to bend over and the angle cannot be too large because the staple will tend to pull out of the wood and because the friction force between the wood members is reduced. Thus, the fact of an angular relationship is critical and I have found that insertion of the staples in the range of 30° to 40° from the vertical is preferred. At angles of 50° and higher, the effect of friction is too slight in proportion to the total horizontal load, i.e., the actual shear on the staple is too large a percent of the horizontal load and the friction does not sufficiently reduce the shear on the staple. At angles of 60° and above, the actual shear may exceed the vertical load which means that no real benefit is being obtained since the object is to minimize the number of fasteners while providing sufficient tension in the fasteners to create friction between the wood chord members. At angles of 20° and less, the fastener will tend to bend. Thus, I have determined that a range of 30°–40° from the vertical is preferred for the angle of insertion of the fastener.

Within the general range of 30°–40° from the vertical, the staple 10 of the present invention should be inserted into the adjoining wood members on the hypotenuse 50 of a force vector diagram with the hypotenuse 50 extending generally upwardly toward the nearest end of the beam. The horizontal component of the force vector diagram is the shear 48 and the vertical component is the vertical load 47. It may be appreciated that the hypotenuse of the force vector diagram will not be at constant angle along the length of a beam. In constructing composite beams, it may be difficult to insert the fasteners exactly upon the hypotenuse without utilizing excessive time thereby substantially increasing the labor cost involved. Accordingly, it is contemplated that all the fasteners will be arranged in most cases at angles of 30°–40° from the vertical. The fasteners at the opposite end of the beam (not shown in FIG. 5) will be inserted at the same angle from the vertical but measured in a clockwise direction whereas the angle of insertion of the fasteners in FIG. 5 is illustrated as being measured from the vertical in a counter-clockwise direction. Thus, all the staples are under tension when the beam is loaded.

The angularity of the fasteners places the fasteners in tension under applied beam loads. The greater the applied load, the greater the resistance of the fasteners to stretching and thus, the greater force applied by the fasteners to compact or squeeze together the adjacent wood pieces which increases the static friction. In essence, there is a self-energizing effect which increases the resistance to relative slippage between the wood strips in response to increased loads applied to the beam.

FIG. 6 illustrates, in diagrammatic form, the interlocking coaction between the first and second "series" of corrugations and the fibers of the wood chords when the staple is inserted at an angle from the vertical. Specifically, when the chords are subjected to loading, the staple 10 is placed in tension as illustrated by the vector "T". The horizontal component of the force vector causes compression on the ends of the wood fibers at 52 and 54 in the wood members 40, 44, respectively. The wood fiber ends also interlock with the corrugations 20, 21, 22 and 23. Since the endwise compressive strength of wood is quite high, a tight interlock is formed. If, however, the staples are inserted at either too great or too small an angle from the vertical, the wood members will splinter and the staples will pull out of the wood.

The wood members are held in tight contact with each other and the staples cannot bend unless the wood deforms. Furthermore, the third "series" of corrugations, because of its unique orientation, increases the stiffness of the staple to further resist horizontal shear forces and thus further resists any tendency to bend.

FIG. 9 illustrates the insertion of the staple 10 into adjacent wood members 42, 44. As a force is applied at the trailing edge 14 of the staple 10, illustrated generally by arrow 56, the leading edge 12 of the staple bites into the wood members. The force at 56 may be applied by a hammer, by a staple gun or by a machine for driving the staples into the wood. As the staple 10 is driven further into the wood, the angularity of the first and second series of corrugations relative to each other causes the fibers of the wood to move within the corrugations as illustrated generally by arrows 58 and this results in the wood members 42 and 44 being drawn together along their respective length as illustrated by arrows 60.

As the staple continues to be driven into the wood, the wood fibers 62 tend to separate to accommodate the third series of corrugations 24, 25. However, due to the orientation of the grain and the resiliency of the wood fibers, these wood fibers 62 move back toward their initial position and close around and abut against the corrugations 24, 25 thus resisting any possible pulling out of the staples.

The present invention provides another unique and unexpected benefit. Not only are the cross-sectional sizes of the chords reduced, as heretofore explained, but, in addition lesser grade or lesser strength wood may also be used for part of the beam. When a beam is constructed according to the principles of the present invention the filler blocks and top chord (which is under compression) may be of a weaker, less expensive wood than the bottom chord (which is under tension) thus further reducing the overall cost of the beam. In many instances the center or filler blocks may be eliminated and the top chord may still be of a weaker, less expensive wood than the lower chord and weaker and less expensive than the lumber used in prior art chords.

The foregoing is a complete description of a preferred embodiment of the present invention and it should be recognized that many modifications may be made without departing from the spirit and scope of the present invention. Thus, the invention should be limited only by the following claims.

What is claimed is:

1. An improved metal staple of the type used for securing together pieces of wood in an abutting relationship, said staple being generally flat and rectangular and having a leading edge and a trailing edge, said leading edge defined as the edge which is inserted into the pieces of wood, said staple further having opposed sides the improvement comprising:

first corrugation means extending from the leading edge to said trailing edge, said first corrugation means including two parallel spaced apart corrugations which are generally semi-circular in cross-section, each of said corrugations of said first corrugation means having a longitudinal axis oriented at an acute angle relative to said leading edge;

second corrugation means extending from said leading edge to said trailing edge, said second corrugation means including two parallel spaced apart corrugations which are generally semi-circular in cross-section, each of said corrugations of said second corrugation means having a longitudinal axis oriented at an acute angle relative to the leading edge of said staple;

the longitudinal axes of the corrugations of said second corrugation means intersecting the longitudinal axes of the corrugations of said first corrugation means; and third corrugation means wherein said third corrugation means includes upper and lower spaced apart parallel corrugations which are generally semi-circular in cross-section, said upper and lower corrugations extending between and interconnecting a corrugation of said first corrugation means and a corrugation of said second corrugation means, the longitudinal axis of said upper corrugation being adjacent to said trailing edge and the longitudinal axis of said lower corrugation being adjacent to said leading edge, said upper corrugation being shorter than said lower corrugation, and the longitudinal axes of said upper and lower corrugations being parallel to said leading edge, and wherein all of said corrugations are formed on the same surface of said staple.

2. The invention as defined in claim 1 wherein the acute angle of orientation of said first corrugation means and the acute angle of orientation of said second corrugation means are the same.

3. The invention as defined in claim 1 wherein said staples further include notches for aligning said staples when the staples are in a nested relationship.

* * * * *